US005447170A

United States Patent [19]

Stein et al.

[11] Patent Number: 5,447,170

[45] Date of Patent: Sep. 5, 1995

[54] APPARATUS FOR CLEANING FILM

[75] Inventors: Ronald E. Stein, Beverly Hills, Calif.; Rod A. Wayne, Pickering, Canada

[73] Assignee: Magnasonics, Inc., Beverly Hills, Calif.

[21] Appl. No.: 144,651

[22] Filed: Oct. 27, 1993

[51] Int. Cl.[6] ..... B08B 3/04

[52] U.S. Cl. ..... 134/64 P; 134/122 P; 134/184; 134/69; 134/78

[58] Field of Search ..... 134/64 P, 64 R, 122 P, 134/122 R, 184, 66, 69, 78, 82, 133, 157; 68/355; 15/308, 309.1; 354/325, 300, 303, 339, 340

[56] References Cited

U.S. PATENT DOCUMENTS

| | | | |
|---|---|---|---|
| 2,492,133 | 12/1949 | Cobb | 134/64 R X |
| 2,618,210 | 11/1952 | Mayer | 134/64 R X |
| 2,694,307 | 11/1954 | Henry | 68/355 |
| 2,967,119 | 1/1961 | Gutterman . | |
| 3,079,699 | 3/1963 | Fry, Jr. | 134/64 R X |
| 3,158,886 | 12/1964 | Grimes | 134/64 R X |
| 3,370,982 | 2/1968 | Hayunga | 134/64 R |
| 3,575,100 | 4/1971 | Krause | 134/64 P |
| 3,595,160 | 7/1971 | Mensinga | 134/122 P |
| 3,668,905 | 6/1972 | Schlunke | 68/5 D |
| 3,737,941 | 6/1973 | Miller et al. | 134/64 R X |
| 3,969,828 | 7/1976 | Roberts | 134/64 R X |
| 4,211,580 | 7/1980 | Vowles | 134/122 P X |
| 4,804,420 | 2/1989 | Johnson et al. | 134/64 R X |

FOREIGN PATENT DOCUMENTS

| | | | |
|---|---|---|---|
| 1590576 | 6/1981 | United Kingdom | 134/122 P |

*Primary Examiner*—Frankie L. Stinson

[57] ABSTRACT

A film cleaning apparatus and method is disclosed where apparatus includes a feed reel and a take-up reel, and a film path created by a number of particle transfer rollers. Also in the film path is a region of high humidity followed by two buffing rollers for polishing the film to be cleaned. Two of the rollers are connected to a vibration generator mechanism. Vibration of the rollers is caused by a rotating disk having two embedded magnetic elements which pass closely adjacent to magnetic elements at the end of rollers' shafts. As the rotating magnets pass by the two shafts, a repulsion force causes the shafts to move away. Connected to each of the shafts is an O-ring which acts as a compression spring that biases its respective shaft back to its starting position after the magnetic elements have moved away from each other. By rotating the disk with the magnetic elements at 3600 rpm a vibration is set up in the shafts at a rate of 7200 times per minute. The region of high humidity is created by a vapor generating apparatus which includes a water container, a float meter, a reservoir, electronics to sense the position of the float so that a valve may be opened or closed, a transducer to excite the water and increase the amount of water vapor and a pump to move the water vapor from the reservoir to a cylindrical tube through which the film to be cleaned is passed. The particle transfer rollers have an outer layer of polyurethene for picking up dust, dirt and other debris from the film. The rollers have a quick release mechanism to allow the polyurethene layer to be removed and cleaned or replaced with a fresh polyurethene layer.

25 Claims, 4 Drawing Sheets

APPARATUS FOR CLEANING FILM

TECHNICAL FIELD

The invention relates to film cleaning devices and more particularly, to film cleaning apparatus including particle transfer rollers, vibrating rollers and a region of high humidity through which the film passes.

BACKGROUND ART

The cleaning of motion picture film has presented a long standing problem of great importance to the entertainment industry. The completion of a motion picture results in only one original film which has been handled and spliced many times. The original also represents a very valuable asset which must not be damaged. However, before exhibition numerous copies must be made and the quality of these copies must be as close to the original as possible.

Before a film can be copied it must be cleaned. Otherwise dust, grease and other debris which is on the film will affect light transmission to the copy and thus degrade its quality. Moreover, debris on the original may permanently injure the film surface and degrade its quality also.

Machines for cleaning film are generally available with one group made by Lipsner-Smith Co. of Lincolnwood, Ill. Lipsner-Smith has two models, CF 3000 VCS and CF 3000-MK V. Generally, the Lipsner-Smith machines feature a liquid cleaning system where the film proceeds into a cleaning tank filled with solvent and the solvent is subjected to ultrasonic waves. The film is then sprayed and dried before proceeding to a take-up reel. The Lipsner-Smith machines are advertised to be a closed system so that little solvent vapor can escape and where most of the solvent is reclaimed.

Because the solvent vapors are considered dangerous to both working personnel and the environment, there is a need for venting and a need for the venting to be accomplished in an environmentally safe manner. The solvent handling and reclamation system includes expensive refrigeration, purification, pumping, and filtration equipment, and because the film must also be dried, the drying system includes expensive compressor, heating, and filtering equipment.

Finally, the Lipsner-Smith system uses a sprocket drive for moving the film and this may cause injury to the sprocket openings along the periphery of the film to be cleaned. The Lipsner-Smith machines are relatively complicated and expensive, and they are environmentally dangerous and require the film to be immersed in a liquid. Wetting film is always dangerous because should one part of the film touch another, the two parts will immediately stick to each other and ruin the surface coating. More detail of the Lipsner-Smith machines may be gathered from a patent issued in 1961 to the company, U.S. Pat. No. 2,967,119.

Another company, Peterson International Enterprises Ltd. of Glenview, Illinois makes machines similar to Lipsner-Smith but instead of ultrasonic waves to agitate the solvent, Peterson uses scrubbers in the solvent. All of the problems afflicting the Lipsner-Smith machines also trouble the Peterson machines.

In a recent article in the June, 1993 issue of *Image Technology*, John P. Pytlak and Dale R. Morrison of the Eastman Kodak Company describe the use of particle transfer rollers ("PTR") for cleaning film. These rollers have an outer layer made of soft polyurethene which produces a roller with a "tacky" surface to which dirt particles will stick if the film comes into contact with the rollers.

While PTR technology offers promise for film cleaning it is in itself insufficient, and thus, there is no safe, economical and efficient system for cleaning film.

OBJECTS OF THE INVENTION

An object of the present invention is to clean film in an efficient, simple, reliable and relatively inexpensive manner with a machine that is commercially feasible.

Another object of the present invention is to clean-film using an environmentally safe method and apparatus.

A further object of the present invention is to clean film by vibration of particle transfer rollers.

Yet another object of the invention is to polish film by exposing the film to a region of high humidity.

The foregoing objects and corresponding advantages, features and results of the present invention, together with various other objects, advantages, features and results thereof, which will be evident to those skilled in the art in light of this disclosure, may be achieved with the exemplary embodiment of the invention described in detail hereinafter, and illustrated in the accompanying drawings.

BRIEF SUMMARY OF THE INVENTION

In one sense the apparatus of the present invention includes a support, a feed shaft for a film reel, a take-up shaft for a film reel; a number of particle transfer rollers positioned to provide a film path between the feed shaft and the take-up shaft, and a vibration generator attached to at least one of the particle transfer rollers so that the film will be exposed to gentle lateral vibrations.

In addition, a vapor bathing apparatus is provided to increase humidity at a specific region of the film path so that the film is exposed to a region of high humidity.

The advantages of the invention is that film will be cleaned in an efficient and relatively inexpensive manner with an apparatus and method that does not effect the environment adversely nor the personnel who operate the apparatus.

DETAILED DESCRIPTION

Figure 1:
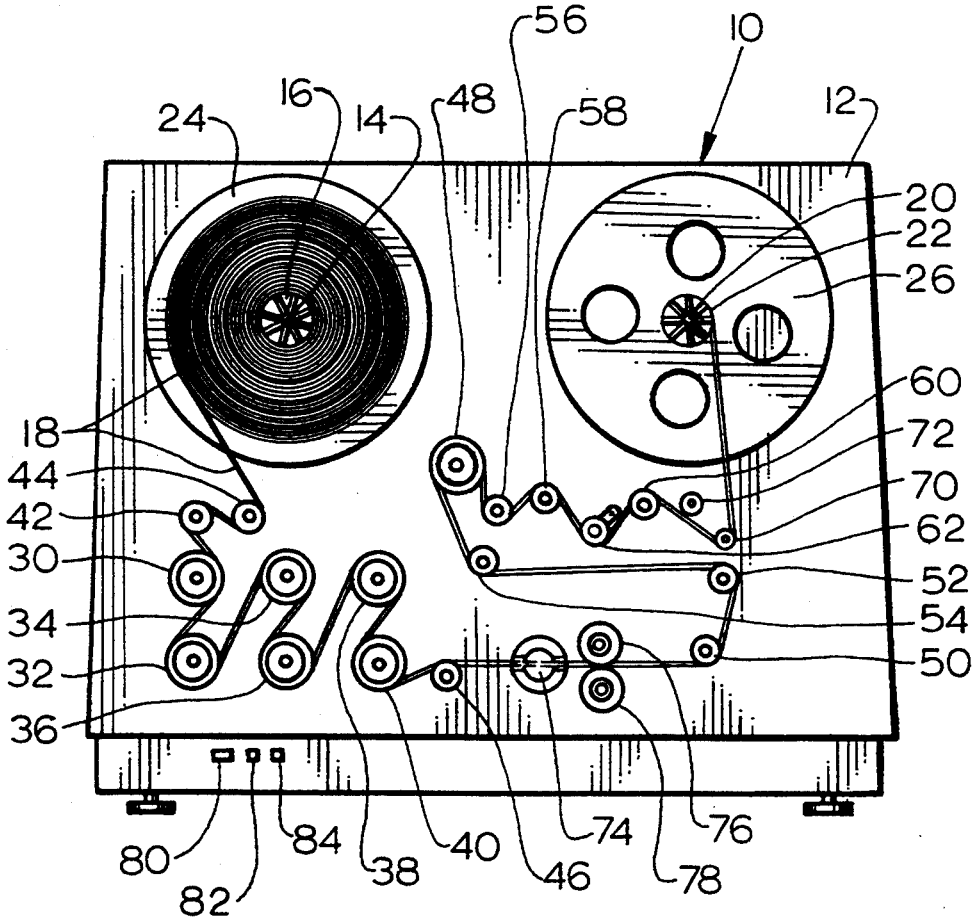
FIG. 1 is a diagrammatic front view of a support panel, a feed reel, a take-up reel, a number of particle transfer rollers and a region of high humidity.

While the present invention is susceptible of various modifications and alternative constructions, an embodiment is shown in the drawings and will herein be described in detail. It should be understood, however, that it is not the intention to limit the invention to the particular form disclosed; but, on the contrary, the intention is to cover all modifications, equivalencies, and alternative constructions falling within the spirit and scope of the invention as expressed in the appended claims.

Figure 2:
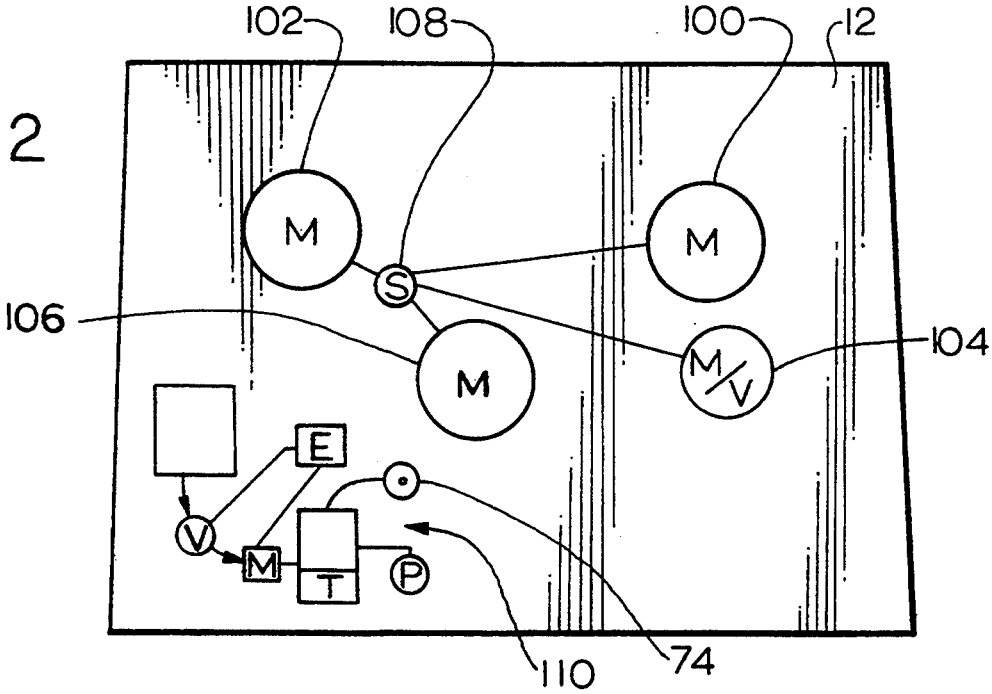
FIG. 2 is a diagrammatic back view of the panel of FIG. 1 illustrating the vapor generator apparatus and the motors for operating the feed and take-up reels, the film drive and the vibrator apparatus.

Referring now to FIGS. 1 and 2 a preferred embodiment of a film cleaning apparatus 10 is shown and will be described in detail. The film cleaning apparatus comprises a support deck plate 12 to which is mounted a feed shaft 14. Mounted on the feed shaft is a feed reel 16 containing film 18 to be cleaned. At the downstream end of a film path which will be described, is a take-up shaft 20 to which is mounted a take-up reel 22. Between the film 18 on the feed reel 16 and the support plate 12 is a backing disk 24 while a similar backing disk 26 is positioned between the support plate 12 and the take-up reel 22.

Also mounted to the support panel are a plurality of particle transfer rollers such as the six large rollers 30, 32, 34, 36, 38 and 40 and two smaller roller 42 and 44. The two smaller rollers are mounted so as to vibrate. There are also a positioning roller 46, a drive roller 48, six smaller particle transfer rollers 50, 52, 54, 56, 58 and 60 and a pivotally mounted roller 62. Immediately before being wound on the take-up reel 22, the film proceeds around a positioning roller, either a "wide" roller 70 if the film is 35 millimeters in size or a "narrow" roller 72 if the film is 16 millimeters in size. The rollers 46 and 48 are also particle transfer rollers.

Also connected to the support panel 12 are a vapor chamber 74 and buffing rollers 76 and 78. The location of the various rollers and the vapor chamber define the path taken by the film from the feed reel to the take-up reel during the cleaning process.

Located beneath the bottom of the support panel are an "on-off" switch 80, a "run" switch 82 and a "stop" switch 84.

Referring now to FIG. 2, there is illustrated in diagrammatic form the back of the support panel 12. There is shown a feed motor 100 to drive the feed reel 16, a variable speed torque motor 102 to drive the take-up reel 22 at an increasingly slower rpm as the film winds around the take-up reel, a motor 104 to operate a vibrator apparatus and a motor 106 to rotate the drive roller 48. Connected to all of the motors is a switch 108 for turning the motors off depending upon the position of the pivotally mounted roller 62. When the roller 62 is no longer supported by the film strip it will drop causing the switch to move to its "off" position and thereby disengage the motors 100, 102, 104 and 106 from an electrical power source (not shown). Also shown in FIG. 2 is a diagrammatic version of the vapor apparatus 110 of which the vapor chamber 74 is a part, as will be explained below.

It is to be noted that a the drive roller 48 is not a sprocket but rather it is a smooth particle transfer roller. Unlike past cleaning devices, a sprocket is not used so as not to damage the film. Sprocket drives tend to damage the sprocket openings of the film. Nevertheless, a speed of 200 feet per minute is attainable in the configuration disclosed.

Figure 3:
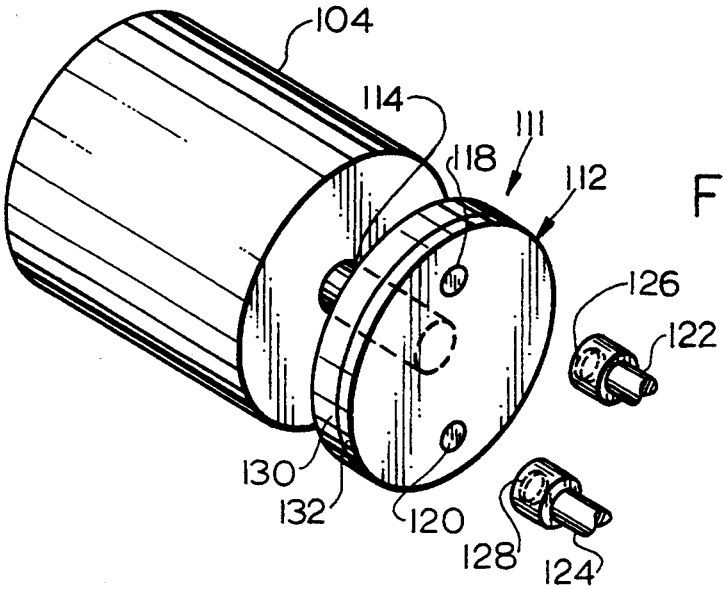
FIG. 3 is an exploded perspective view partially broken away of the vibrator apparatus.

In keeping with the objects of having the inventive apparatus simple, reliable and relatively inexpensive but yet effective, the preferred embodiment includes the vibrator apparatus 111 for creating a gentle agitating action on the film to facilitate the loosening of dirt. Referring to FIG. 3, the vibrating apparatus is shown to comprise a first mounting element in the form of a disk 112 which is attached to a shaft 114 of the motor 104. The motor acts as a means for rotating the disk. Connected to and supported by the disk are two magnetic elements 118, 120. Located a short distance away are two shafts 122 and 124, each of which has at its end facing the disk an additional magnetic element. One shaft 122 includes a magnetic element 126 and the other shaft 124 includes a magnetic element 128.

Figure 4:
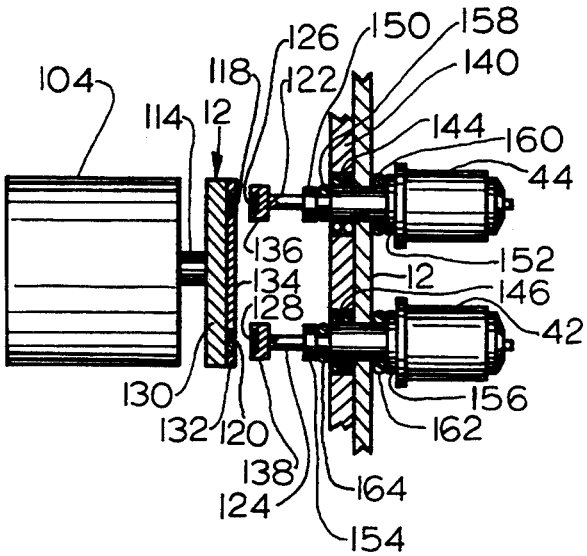
FIG. 4 is a side elevation view partly in section of the vibrator apparatus.
Figure 5:
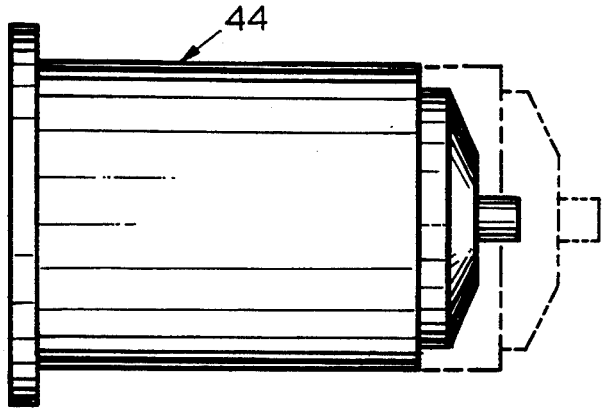
FIG. 5 is an enlarged side elevation view of a vibrating roller.

Referring now to FIGS. 4 and 5, the elements and operation of the vibrating apparatus will be explained in more detail. The motor 104 is preferably a DC motor of one quarter horsepower which may be obtained commercially. The DC motor has a varying rotational speed; however, it is contemplated that the preferable operating rotation is about 3600 rpm. Connected to the motor's shaft 114 in the usual fashion is the disk which preferably is comprised of two portions; a backing disk portion 130 of 6061T6 aluminum, a nonferrous material. The backing disk is preferably 0.25 inches thick and has two recesses into which the two magnets 118 and 120 are placed. Mounted over the backing disk 130 is a holding disk portion 132 which is also made of 6061T6 aluminum and is approximately 0.0625 inches thick. The holding disk has two openings which are slightly smaller than the magnets 118 and 120 so that when the holding disk portion is attached to the backing disk portion, such as by screws, the slightly undersized openings will act as a restraint to prevent the magnets 118 and 120 from dislodging.

The disk magnets 118 and 120 are quite powerful. They are each preferably 0.50 inches in diameter and are of a thickness of 0.125 inches. The material of the magnets is neodymium iron boron having energy densities of 27–35 million gauss oersteds.

Positioned a short distance from the facing surface 134 of the holding disk 132 are ends 136 and 138 of the shafts 122 and 124 respectively. Embedded in the end 136 of the shaft 122 is the magnet 126, while embedded in the end 138 of the shaft 124 is the magnet 128. The gap between magnetic elements 126 and 128 on the shafts and magnetic elements 118 and 120 on the disk is between 0.020 and 0.050 inches. Preferably the distance is approximately 0.030 inches.

The magnetic elements 126 and 128 are of the same dimensions, material and energy densities as described for the magnetic elements 118 and 120.

The magnetic elements are arranged to "push-push" so that every time the disk rotates so as to place the magnetic elements opposite each other, which happens twice every revolution, there is a substantial repulsion force created which tends to separate the rotating disk from the shafts. The shafts are mounted to allow linear movement in a bearing block 140 which in turn is attached to the deck plate 12. The bearing block has two openings and bronze bearings 144 and 146 placed in the openings to receive the shafts 122 and 124 respectively. By mounting the shafts on the bearings the shafts are allowed to move back and forth in a linear motion. Stated another way, the shafts are positioned to vibrate at twice the number of revolutions per minute of the rotating disk, preferably at a rate of about 7200 times per minute. The shafts include left and right shoulders, such as shoulders 150 and 152 respectively, of the shaft 122 and shoulders 154 and 156 of the shaft 124. Mounted in recesses adjacent the shoulders are left and right O-rings 158 and 160 on the shaft 122 and O-rings 162 and 164 on the shaft 124.

When the magnetic elements are set in a "push-push" relationship, the O-rings 158 and 164 positioned to the left will act as a spring while the O-rings 160 and 162 positioned to the right will act as damping devices. When the magnetic elements are opposite one another a repulsion force is generated causing the shafts to move rightwardly. This in turn causes the shoulders 150 and 154 to compress the O-rings 158 and 164 respectively. Once the magnetic elements no longer oppose each another, the compressed O-rings will act as compressed springs and expand back to their original dimensions thereby biasing the shafts in a leftward direction. The rightward located O-rings 160 and 162 will damp this return movement. In this way a gentle vibration is set up in the shafts and act upon the film to loosen dirt. The range of linear motion of the shafts may be between 0.001 to 0.005 inches though preferably the movement is approximately 0.002 inches.

Mounted to the shafts and rotatable relative to them are the two rollers 42 and 44. In operation, the film moves around the roller for a predetermined arc. Preferably the rollers include a thick polyurethene surface that causes the transfer of particles from the film to the rollers. As shown in FIG. 5, the rollers move between the position shown in the solid line to the position shown in phantom line and back again, approximately 7200 times per minute in the arrangement illustrated here and with the motor operating at about 3600 rpm. The combination of the roller's polyurethane surface and their linear movement back and forth causes a gentle yet effective scrubbing action which is gentle enough to prevent scratching of the film yet effective in loosening and transferring unwanted particles from the film.

Figure 6:
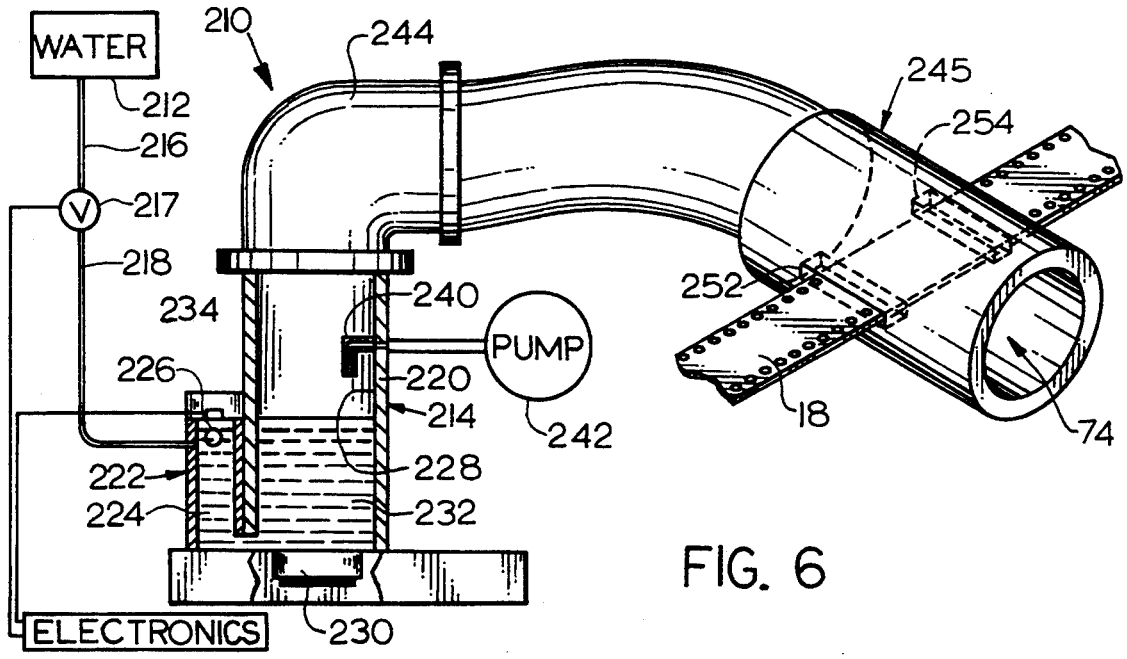
FIG. 6 is part diagrammatic, part perspective view illustrating the vapor generator.

Also in keeping with the objects of simplicity, reliability and low cost, reference is made to FIG. 6 which shows a vapor bathing apparatus 210 that includes generally a water reservoir in the form of a water container 212, a vapor generating device 214 and the vapor chamber 74 through which the film to be cleaned is passed.

In more detail, the water container 212 may be of any suitable material and size such as a one gallon plastic household container. The container is connected through a tube 216 to a valve 217 and through a tube 218 to the vapor generating device 214. The device is a tubular reservoir member 220 which receives the water through a metering mechanism 222. The metering mechanism includes a float chamber 224 and a float 226 and is used to maintain a predetermined water level in a chamber 228 within the tubular member 220. A suitable water level is approximately 1 inch where the tubular member 220 is about 2 inches high with about a 1.5 inch inner diameter and a two inch outer diameter.

An ultrasonic transducer 230 attached at the bottom of the tubular member is used to excite (and warm) the water 232 occupying the lower portion of the chamber 228. This excitation generates a much greater than normal vapor in the upper portions 234 of the chamber. The transducer operates at about 30,000 kilohertz and is an off-the-shelf item such as that made by Daewoo of Korea, Model DU 30A.

Attached to the upper chamber portion 234 is an air tube 240 that in turn is connected to a pump 242. The pump is intended to increase the air pressure in the upper chamber portion 234 causing the generated vapor to move through a conduit 244, toward the vapor chamber 74.

Figure 7:
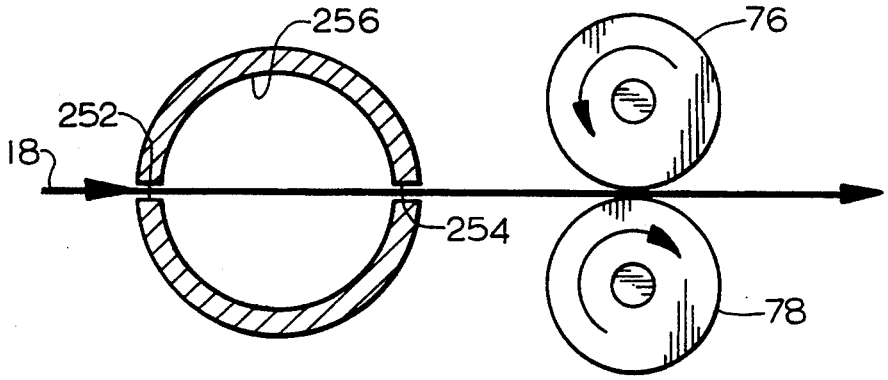
FIG. 7 is an enlarged front elevation view illustrating film passing through a region of high humidity followed by the film passing through buffing rollers.

The vapor chamber is formed by a tubular element 245 which is cylindrical in shape, approximately 2.5 inches in length, with a 2 inch outer diameter and a 1.5 inch inner diameter. To enable observation it has been found that clear acrylic may be used as the material for the tube To have a film strip pass through the generated vapor or the region of high humidity existing in the vapor chamber, oppositely positioned slots 252 and 254 are formed in the wall of the cylindrical tube. As shown in FIG. 7 the film 18 enters the interior 256 of the cylindrical tube through the slot 252 and egresses from the interior of the tube through the slot 254. During this passage the film is exposed to the high humidity caused by the vapor which is generated by the vapor generating device. This causes the film to be exposed to the high humidity momentarily as it passes through the cylindrical tube. However, at no time is the film immersed in water or a solvent as in the prior art.

Immediately upon egress through the slot 254 the film is passed between the two counter-rotating lambs wool buffing rollers 76 and 78 which polishes the film and also removes any particles not yet removed and that have been loosened by the exposure of the film to the high humidity. Additional sets of counter-rotating rollers for buffing may be used if desired.

It is important to note the difference between the cleaning of film by exposure to a region of high humidity as compared to immersion of the film in a chemical bath as is now the prevailing practice. First the chemical bath requires expensive equipment to contain and filter the liquid, the expense of the chemicals themselves and even more expensive equipment to ensure that toxic fumes from the chemicals are properly handled from environmental and personal safety standpoints. Next, the size of the chemical bath equipment as well as the liquid is quite substantial when compared to the present invention. Finally, there is no need for expensive drying equipment or procedures as required by chemical bath systems.

In operation of the vapor bathing apparatus, the water from the container 212 passes through the tubes 216 and 218 into the interior 228 of the tubular member 220. The metering device 222 ensures that the water level within the interior of the tubular member is maintained at approximate a constant level. The ultrasonic transducer connected to the tubular member 220 is used to excite the water and create a substantial vapor in the upper portion 234 of the chamber. The vapor is pressurized as to flow through the conduit 244 to the cylindrical tube 245 where the vapor and the moving film strip to be cleaned come into contact. The film is exposed to a very high humidity, and thereafter, it is polished by the set of counter-rotating rollers 260 and 262.

Figure 8:
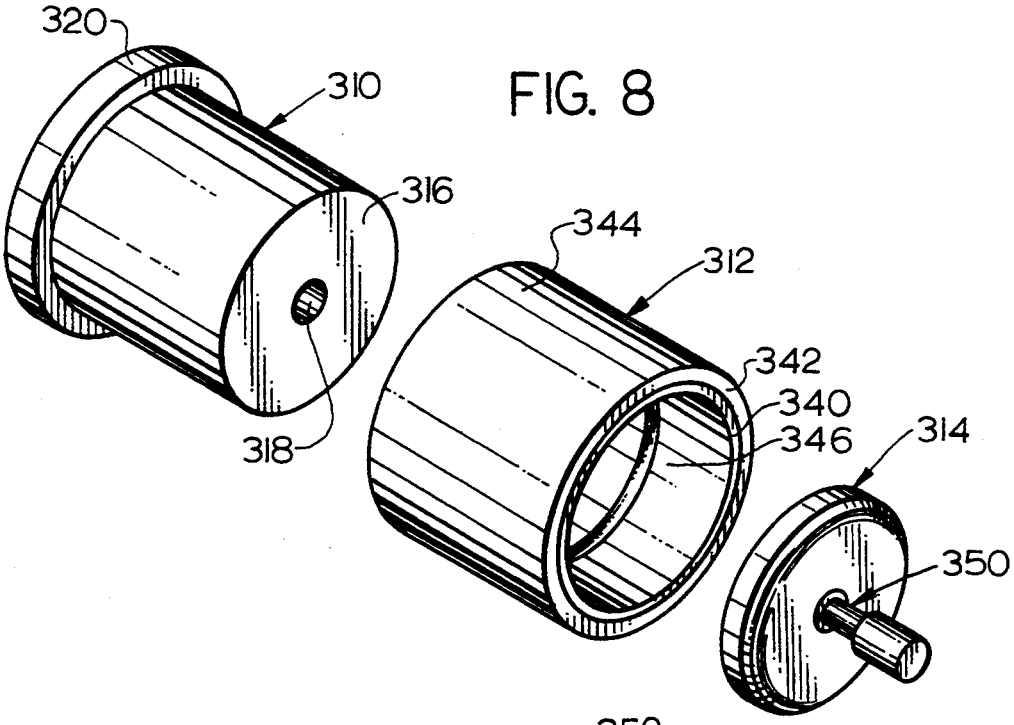
FIG. 8 is an exploded perspective view of a quick release roller apparatus.

Attention is now directed to FIG. 8 in which a simple, reliable, yet relatively inexpensive quick release roller is shown having a base roller 310 to which a particle transfer roller 312 is mounted. The roller is kept in place by a restraining plate 314.

The base roller 310 is generally cylindrical in shape and includes at one end an end wall 316 with a central opening 318, and at the other end a shoulder 320.

Figure 9:
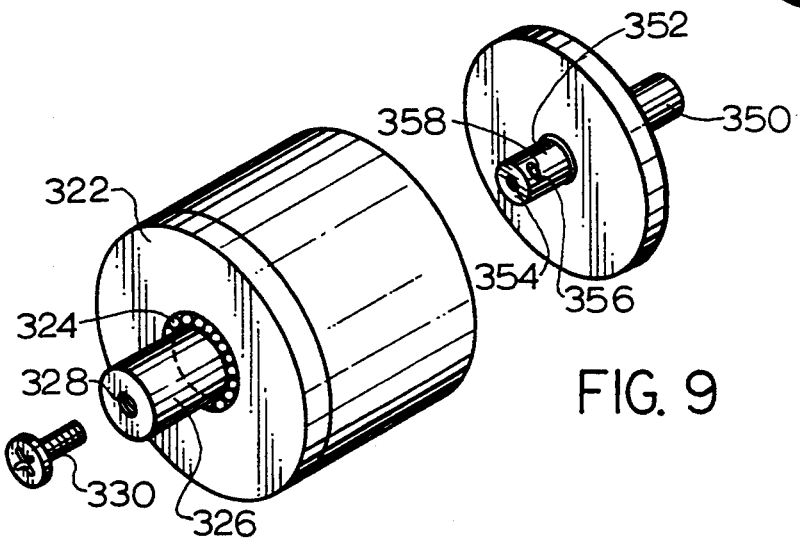
FIG. 9 is a rear exploded perspective view of the quick release roller.
Figure 10:
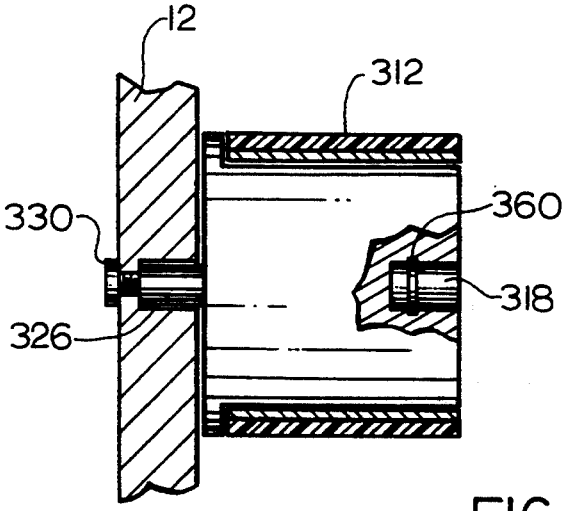
FIG. 10 is a side sectional elevational view of a portion of the quick release roller apparatus.

As seen in FIG. 9 the other end of the cylinder has a wall 322 with an opening into which bearings 324 are mounted. In turn, the bearings receive a mounting shaft 326. The mounting shaft has a central opening 328 to receive a threaded fastener 330. The shaft 326 and the threaded fastener 330 cooperate to mount the roller to the deck plate 12 such as shown in FIG. 10.

Mounted to the base roller is the particle transfer roller 312 which has a tubular aluminum base 340 to which is molded a polyurethene layer 342. The outer surface 344 of the polyurethane has an adhesive quality such that when it comes in contact with dust or dirt on another article in contact with the surface, the surface will cause the dust or dirt to be transferred to the polyurethane. The particle transfer roller 312 may be mounted onto the base 310 by sliding the transfer roller over the base until it abuts the shoulder 320. It is desirable that the base 310 have the same dimension as the width of the transfer 312 so that the edge of the roller is generally flush with the end wall 316 as shown in FIG. 10.

A friction fit is created between the roller 312 and the base 310 by having O-rings such as O-ring 345 mounted within a groove in the interior surface 346 of the aluminum base sleeve 340. However, to ensure that the roller 312 does not work its way off the base roller, the restraining plate 314 is attached so as to be positioned adjacent the end wall 316. The diameter of the restraining plate 314 is slightly larger than the inside diameter of the aluminum base 340 so that there will be interference between the transfer roller 312 and the restraining plate 314 when the roller 312 moves to the right as shown in FIG. 8.

The rollers are commercially available from San Lab Systems, Inc., 1000 Timmins Gardens, Pickering, Ontario, Canada.

To allow quick release and easy connection of the restraining plate there is a locking means 350, FIGS. 8 and 9. The locking means includes a housing 352 which is fastened to the restraining plate and within the housing is a longitudinally moveable plunger 354. The plunger is spring biased so that if the plunger is displaced it will return to its original position. In the wall of the housing is an opening 356 into which is placed a ball 358.

The locking function is achieved by the ball which is moveable between two positions. When the plunger is in its "at rest" or extended position the outer wall of the plunger (not shown) bears against the ball 358 causing it to be extended outwardly from the housing 352. However, when the plunger is depressed against the spring a smaller diameter portion of the plunger moves opposite the ball allowing the ball to be retracted and thus be in its unlocked position.

Referring to FIG. 10 the opening 318 is shown in more detail and includes an indentation 360 in the wall of the opening. The indentation is in the form of a circular groove and is in a position to receive the ball 358 when it is protruding. The interference between the ball and the wall of the groove 360 causes the locking action. However, unlocking is easily accomplished by depressing the plunger, thereby releasing the camming action on the ball and the ball is allowed to retract into the housing. This retraction will end the interference between the ball and the groove and the ball will easily be removed from the groove. Thus the restraining plate may easily be moved away from the end wall of the base roller.

To assemble, the base roller is attached to the deck plate 12 by having the shaft 326 received by an opening in the deck plate and the fastener 330 is threaded into the shaft. The base roller is ready to receive a particle transfer roller. The roller slides over the base until the roller abuts the shoulder 320. Then the restraining plate is placed over the end wall with the plunger depressed so that the housing 352 is received in the opening 318. Once the housing is completely received, the plunger is released whereupon it is biased back to its extended position. When that occurs the ball 358 in the housing wall is cammed outwardly into the groove 360 thereby making a locking interference fit with the wall of the groove. This locks the restraining plate in place and ensures that the particle transfer roller does not inadvertently slip off the base.

In operation, personal assign to clean a roll of film will place that roll on the feed shaft 14 and then snake the film around the various particle transfer rollers in the following order: rollers 44, 42, 30, 32, 34, 36, 38, 40 and 46. The film is then inserted through the slots 252 and 254 of the cylindrical tube 245. Thereafter, the film passes between the buffing rollers 76 and 78 and around the particle transfer rollers 52, 54, 48, 56, 58, 62 and 60 in that order. The roller 48 is a drive roller which helps move the film along the film path. Depending upon whether the film is 35 millimeters or 16 millimeters in size, the film is passed around either the alignment roller 70 or the alignment roller 72 before attachment to the take-up reel 22 on the take-up shaft 20. The vapor generating apparatus 110 is activated by the pushing of the "on/off" switch 80 so that water in the cylindrical tube 220 is excited by the transducer 230, causing an increase in the amount of water vapor. The vapor is then driven to the cylindrical tube 245 creating a region of relatively high humidity.

The motors 100, 102, 104 and 106 are then activated by pressing the "run" switch 82 causing the film to move along the film path from the feed reel 16 to the take-up reel 22. Cleaning action is achieved by the numerous particle transfer rollers to which dirt, dust and other debris from the film is transferred. This transfer is helped by the vibration of the rollers 42 and 44. Dust or dirt which would not normally transfer to a PTR roller will be dislodged by the vibrating action. The film strip also passes through the relatively high humidity in the cylindrical tube 245. Thereafter, the film strip is immediately polished when it passes between the buffing rollers 76 and 78. After buffing, the film strip again passes along several PTR rollers to remove any dust, dirt or debris which may have been lessened by the high humidity/polishing operation. Thereafter, the film strip is aligned by either the 35 millimeter size roller 70 or the 16 millimeter sized roller 72 before winding about the take-up reel 22.

In an emergency the "stop" switch 84 may be depressed, or under normal circumstances, the film cleaning apparatus will turn itself off after the last of the film passes the pivotally mounted roller 62 which acts as a switch. Once the film is no longer supporting the roller as it is depicted in FIG. 1, the roller will pivot downwardly causing its switch mechanism to disengage the motors from their electrical energy source.

As can be appreciated, the apparatus is relatively simple, efficient and inexpensive and is easy to operate.

Moreover, there is no environmental danger since no solvent is used as part of the system.

We claim:

1. A film cleaning apparatus comprising:
a support;
a feed shaft connected to said support;
a take-up shaft connected to said support;
a plurality of particle transfer rollers connected to said support and aligned to provide a film path between said feed shaft and said take-up shaft; and
means connected to said support for vibrating at least one of said plurality of rollers, wherein
the vibrating means comprises a first mounting element;
means connected to said first mounting element for rotating said first mounting element;
at least one magnetic element connected to and supported by said first mounting element;
a second mounting element;
a shaft connected to and supported by said second mounting element which is adapted to move with a back and forth linear motion;
another magnetic element connected to and supported by said shaft;
said other magnetic element is located where it may be influenced by said first mentioned magnetic element whereby when said first mounting element is rotated a force is exerted on said linear motion element causing it to move back and forth.

2. An apparatus as claimed in claim 1 wherein said shaft is rotatable.

3. An apparatus as claimed in claim 2 including two O-rings positioned about the shaft and spaced one to each side of the second mounting element.

4. An apparatus as claimed in claim 3 wherein one of said O-rings is compressed during movement of the shaft in one direction under the influence of the magnetic elements and biases the shaft in the opposite direction when the influence of the magnetic elements is no longer in effect; and the other O-ring acts as a damping device when the shaft is moving in the opposite direction.

5. An apparatus as claimed in claim 4 wherein the distance of travel of the shaft in its linear motion is in the range of 0.001 to 0.005 inches.

6. An apparatus as claimed in claim 1 wherein there is a gap range between the two mentioned magnetic elements of between 0.020 to 0.050 inches.

7. An apparatus as claimed in claim 1 wherein the magnetic elements are disk shaped having a diameter of approximately 0.05 inches and a thickness of approximately 0.125 inches, and are of neodymium iron boron having energy densities of 27–35 million gauss oersteds.

8. An apparatus as claimed in claim 1 wherein the first mounting element is an aluminum disk.

9. An apparatus as claimed in claim 8 wherein there are two magnetic elements disposed approximately 180 degrees apart mounted to the aluminum disk near its periphery.

10. An apparatus as claimed in claim 1, wherein each of said quickly removable rollers comprises
a mounting shaft;
a mounting roller base connected to the mounting shaft, said base having an end wall with an opening;
a restraining plate; and
means connected to the restraining plate for releasably locking said restraining plate to said roller base wherein said locking means is received in the end wall opening.

11. An apparatus as claimed in claim 10, wherein the locking means includes
a housing sleeve having a wall with an opening therein;
a spring biased plunger supported by said housing and moveable longitudinally within said sleeve; and
a retractable ball positioned in said sleeve opening whereby movement of said plunger causes said ball to move from a retracted unlocking position to a protruding locking position.

12. An apparatus as claimed in claim 11, wherein when said plunger is at rest said ball is in its locking position and when said plunger is pushed inwardly against the springs said ball is in its unlocking position.

13. An apparatus as claimed in claim 12, including an indentation in the end wall opening for receiving the ball when it is in its locking position.

14. An apparatus as claimed in claim 13, wherein said vibrating means comprises
a first mounting element;
means connected to said first mounting element for rotating said first mounting element;
at least one magnetic element connected to and supported by said first mounting element; a second mounting element;
an element connected to and supported by said second mounting element which is adapted to move with a back and forth linear motion;
another magnetic element connected to and supported by said linear motion element;
said other magnetic element is located where it may be influenced by said first mentioned magnetic element;
when said first mounting element is rotated a force is exerted on said linear motion element causing it to move back and forth;
wherein said linear motion element is a rotatable shaft;
two O-rings positioned about said shaft and spaced one to each side of the second mounting element;
wherein one of said O-rings is compressed during movement of the shaft in one direction under the influence of the magnetic elements and will bias the shaft in the opposite direction when the influence of the magnetic elements is no longer in effect; and
the other O-ring acts as a damping device when the shaft is moved in the opposite direction.

15. An apparatus as claimed in claim 14, wherein said increasing humidity means comprises
a water reservoir;
a chamber adapted to have a measured amount of water;
means connecting the reservoir and the chamber for transporting water from the reservoir to the chamber;
an ultrasonic transducer at the bottom of said chamber for creating vapor;
a tubular element for receiving vapor that is created;
means connecting the chamber and the tubular element for transporting creative vapor; and
means connected to the tubular element for allowing entry and egress of film to be exposed to the created vapor whereby the film when passed through the tubular element will be bathed in the created vapor;

a pump communicating with the chamber for causing the created vapor to move through the transporting means to the tubular element; and a pair of buffing rollers positioned adjacent to said tubular element for polishing the film.

16. An apparatus is claimed in claim 15, wherein each of said quickly removable rollers comprises a mounting shaft;

a mounting roller base connected to the mounting shaft, said base having an end wall with an opening;

a restraining plate;

means connected to the restraining plate for releasably locking said restraining plate to said roller base wherein said locking means is received in the end wall opening;

the locking means includes a housing sleeve having an opening in its side wall, a spring biased plunger supported by said housing and moveable longitudinally therein, a retractable ball positioned in said housing sleeve opening whereby movement of said plunger causes said ball to move from a retracted unlocking position to a protruding locking position.

17. A film cleaning apparatus comprising:

a support;

a feed shaft connected to said support;

a take-up shaft connected to said support;

a plurality of particle transfer rollers connected to said support and aligned to provide a film path between said feed shaft and said take-up shaft;

means connected to said support for vibrating at least one of si plurality of rollers;

means connected to said support for increasing humidity at a specific region of said film path; and wherein the humidity increasing means comprises:

a water reservoir;

a chamber adapted to have a measured amount of water;

means connecting the reservoir and the chamber for transporting water from the reservoir to the chamber;

an ultrasonic transducer at the bottom of said chamber for creating vapor;

a tubular element for receiving vapor that is created;

means connecting the chamber and the tubular element for transporting said created vapor; and openings in the tubular element for allowing entry and egress of film to be exposed to the created vapor.

18. An apparatus as claimed in claim 17, including a pump communicating with the chamber for causing the created vapor to move through the transporting means to the tubular element.

19. An apparatus as claimed in claim 17, wherein said openings are opposing slots in the tubular element.

20. An apparatus as claimed in claim 19, including a pair of buffing rollers positioned adjacent to said tubular element for polishing the film.

21. A film cleaning apparatus comprising:

a support:

a feed shaft connected to said support;

a take-up shaft connected to said support;

a plurality of particle transfer rollers connected to said support and aligned to provide a film path between said feed shaft and said take-up shaft;

means connected to said support for increasing humidity at a specific region of said film path; and wherein said increasing humidity means comprises:

a water reservoir;

a chamber adapted to have a measured amount of water;

means connecting the reservoir and the chamber for passing water from the reservoir to the chamber;

an ultrasonic transducer in communication with said chamber for creating vapor;

a hollow element for receiving vapor that is created;

means connecting the chamber and the hollow element for passing created vapor; and openings in said hollow element for allowing entry and egress of film to be exposed to the created vapor.

22. An apparatus as claimed in claim 21, including a pump connected to the chamber for causing the created vapor to move through the transporting means to the tubular element.

23. An apparatus as claimed in claim 21, including a pair of buffing rollers positioned downstream of the tubular element for polishing the film.

24. A film cleaning apparatus for moving film between a feeding element and a take-up element comprising:

a roller adapted to be in contact with said moving film, said roller adapted to be vibrated in a back and forth linear scrubbing motion in relation to said film.

25. A film cleaning apparatus comprising:

a support;

a feed shaft connected to said support;

a take-up shaft connected to said support;

a plurality of particle transfer rollers connected to said support and aligned to provide a film path between said feed shaft and said take-up shaft; and means connected to said support for vibrating at least one of said plurality of rollers in a back and forth linear scrubbing motion in relation to the film moving along the film path.

* * * * *